US005336967A

United States Patent [19]

Tomasetti et al.

[11] Patent Number: 5,336,967

[45] Date of Patent: Aug. 9, 1994

[54] STRUCTURE FOR A MULTIPLE SECTION PHOTOMULTIPLIER TUBE

[75] Inventors: Charles M. Tomasetti, Leola; Fred A. Helvy; Donald B. Kaiser, both of Lancaster, all of Pa.

[73] Assignee: Burle Technologies, Inc., Wilmington, Del.

[21] Appl. No.: 902,361

[22] Filed: Jun. 22, 1992

[51] Int. Cl.[5] ..... H01J 40/06; H01J 40/16; H01J 43/18

[52] U.S. Cl. ..... 313/533; 313/540; 313/103 R; 313/542; 313/544

[58] Field of Search ..... 313/533, 532, 540, 103 R, 313/541, 542, 544

[56] References Cited

U.S. PATENT DOCUMENTS

| | | | |
|---|---|---|---|
| 3,067,348 | 12/1962 | Ochs | 313/103 |
| 3,668,388 | 6/1972 | Fisher et al. | 313/533 |
| 4,117,366 | 9/1978 | Davis | 313/536 |
| 4,649,314 | 3/1987 | Eschard | 313/103 CM |
| 4,816,718 | 3/1989 | Lavoute et al. | 313/544 |
| 4,881,008 | 11/1989 | Kyushima et al. | 313/533 |
| 4,937,506 | 6/1990 | Kimura et al. | 313/532 |
| 5,077,504 | 12/1991 | Helvy | 313/533 |

FOREIGN PATENT DOCUMENTS

| | | | |
|---|---|---|---|
| 57-194445 | 11/1982 | Japan | 313/532 |

*Primary Examiner*—Donald J. Yusko
*Assistant Examiner*—Matthew J. Esserman
*Attorney, Agent, or Firm*—Martin Fruitman

[57] ABSTRACT

A multiple section photomultiplier tube. The tube is constructed essentially as a matrix of several independent tubes in one envelope. The photocathode of each individual section of the tube is formed into an independent surface, and the photocathode to dynode spacings are isolated by a configuration built with separator electrodes which connect to photocathode boundary dividers formed in the faceplate. The boundary dividers also isolate the independent photocathode regions. The boundary dividers can be either slots into which the separator electrodes fit or ribs with which the separator electrodes are engaged.

7 Claims, 5 Drawing Sheets

STRUCTURE FOR A MULTIPLE SECTION PHOTOMULTIPLIER TUBE

SUMMARY OF THE INVENTION

This invention deals generally with electric lamp and discharge devices, and more specifically with a photomultiplier tube having plural anodes and dynode cages.

Photomultiplier tubes have become commonly used instruments for detecting low radiation levels. Typically, they consist of a glass envelope with an electron emitting photocathode located on the inside surface of a faceplate on the envelope. When light strikes the photocathode, electrons emitted from it are directed toward and collected by an electron multiplier. The electron multiplier consists of several secondary electron emitting dynodes, the first of which receives the electrons from the photocathode. The several dynodes are usually located in a single grouping, frequently referred to as a dynode cage. The electron multiplier delivers its electrons tip an anode which has an electrical output which is directly related to the quantity of electrons collected by the first dynode.

In order to maximize the collection efficiency of a tube, that is, to increase the ratio of electrons collected by the first dynode relative to the number emitted from the photocathode, focus electrodes are sometimes located between the photocathode and the first dynode. These electrodes are operated at various electrical potentials to create an electrical field between the photocathode and the first dynode. Multiple section photomultiplier tubes are not all that uncommon, They are particularly useful in radiation studies, including the study of light sources, in which the radiation falls on a large area, with different intensities, time sequences or patterns upon various portions of the area irradiated. While such fields can be studied by arrays of individual photomultiplier tubes when the radiation field is large enough, for small fields it is extremely difficult to construct tubes small enough and to pack individual tubes close enough to attain good definition and to avoid blocking out regions with the external envelopes of the adjacent tubes.

Multiple section photomultiplier tubes alleviate this problem by furnishing the effect of several tubes in one envelope. This permits closer packing of the active elements because the adjacent sections are not separated by portions of two envelopes. Several multiple section photomultiplier tubes are now available and are covered in the prior art, but they have problems which are not associated with the use of multiple independent tubes.

One problem is the need to construct and physically locate the multiple sections within a small envelope. One solution to this problem has been to construct similar electron multiplier dynode cages for each of the several sections, to locate them in close proximity to each other and then to attempt to isolate them in terms of the electron optics of the tube sections, so that the sections will operate independently. This has not always been successful.

"Crosstalk", that is, the interchange of electrons between tube sections, is a continuing source of problems in such tubes, and many designs have been proposed to counteract such crosstalk. Crosstalk can occur not only between the electrons generated by the several dynodes, when the electrons move between electron multiplier sections, but also in the region of the tube between the photocathode and the first dynodes of the electron multiplier sections. In the latter situation an electron generated in one section of the photocathode is captured by a dynode associated with another section of the tube, thus yielding false information about the location of light falling on the photocathode.

One solution to this crosstalk in the region between the photocathode and the first dynodes has been to place within that space separator electrodes which divide the region into sections which correspond with the several sections of the tube. While it has been generally acknowledged in the prior art that one end of such separator electrodes should be located in close proximity to the photocathode, no system of mounting such separator electrodes has ever been proposed.

The present invention describes an apparatus in which the separator electrodes are directly engaged with the tube faceplate, and thereby furnishes a system which places the ends of the separator electrodes not merely in close proximity to, but in actual contact with the faceplate upon which the photocathode is located. Not only does this structure completely prevent crosstalk in the region of the tube between the photocathode and the first dynodes, but it also furnishes structural support for the separator electrodes at their ends which have, until now, been unsupported and therefore subject to movement when the tube was subjected to lateral forces from shock or vibration.

Moreover, the engagement of the separator electrode with the faceplate assures perfect registration of the individual dynode cage structures with the individual sections of the photocathode, because the ends of tile separator electrodes remote from the photocathodes are attached to the dynode cages.

The superior registration of the photomultiplier tube of the present invention is of particular benefit when the photomultiplier tube has its photocathode formed on a curved surface with the center of curvature within the tube and therefore focuses the emitted electrons on a limited area of the first dynode. While such a curved photocathode configuration is desirable to reduce transit time spread of the electrons traveling from the photocathode to the first dynode, the small cress section of the electron path near the first dynode means that a slight misalignment between the photocathode and the first dynode will cause some photoelectrons to miss the dynode. The mechanical connection between the photocathode and the dynode cage furnished by the joining of the separator electrode to both of them assures that there will be no deviation in that alignment.

Another benefit of the structure of the invention is that, when the separator electrodes are operated at cathode potential, each tube section simulates the operation of an individual tube whose electron lens is formed by conventional bulb wall aluminizing.

The apparatus of the invention can be constructed in two forms. One configuration is a pattern of slots formed on the inside surface of the faceplate of the tube. In a typical four section tube the slots would form a simple cross pattern on the faceplate. The ends of the separator electrode sections are then simply slipped into the slots, with the intersection of the separator electrode formed by interlocking the sheet metal separator sections, which have slots cut half way through the length of each separator section, like a classic egg crate. With such an interconnection between the separator sections, the intersection of the slots in the faceplate can be of the same thickness and depth as the slots elsewhere on the faceplate.

An alternate configuration of the invention involves raised ribs or short height walls in place of the slots on the faceplate. In such a configuration the separator electrodes require some means to engage the separator electrodes with the ribs. One such configuration is a "C" clamp structure attached to the end of the separator electrode, with the "C" section fitting over the thickness of the raised rib. Other configurations of the engagement arrangement can also be used, such as a series of bent tabs attached to the separator sections, with alternate tabs on opposite sides of the raised rib, or short sections of ribs with the separator electrode interwoven between the sections of ribs.

For both the slot and the rib structure, it is advantageous to metallize the side walls of the slots and ribs. This helps prevent optical crosstalk, that is, light transmission within the faceplate across the boundaries of separated individual photocathodes.

Regardless of the use of slots or ribs in the faceplate of the tube, and regardless of the specific means for connecting the separator electrode to the faceplate, the same beneficial results are derived. The separator electrodes completely isolate each tube section from all the others, and, because the end of the separator electrodes not engaged with the faceplate are mechanically attached to the dynode cages, the separator electrodes form a connection between the faceplate and the dynode cages and assure that each section of the photocathode is always accurately aligned with its associated electron multiplier.

DETAILED DESCRIPTION OF THE INVENTION

Figure 1:
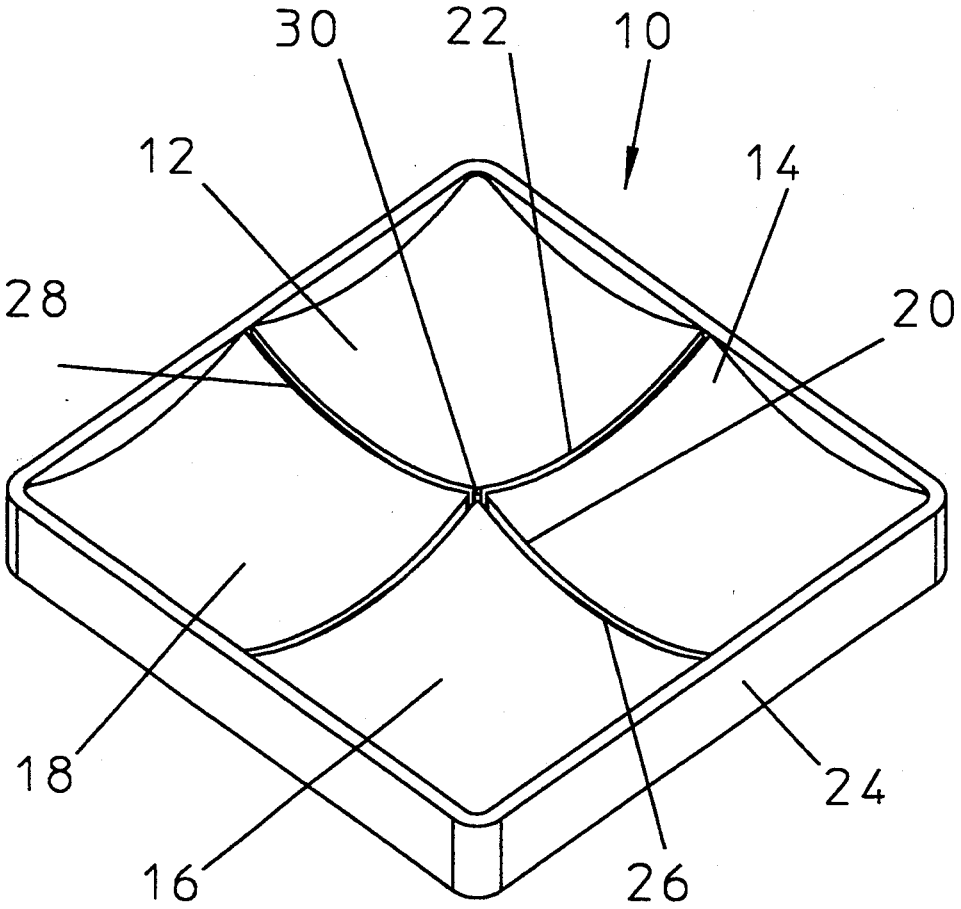
FIG. 1, is a perspective view of the face plate of the preferred embodiment shown with curved photocathode sections and slots for engagement of the separator electrodes.

FIG. 1 is a perspective view of the faceplate of a four section photomultiplier tube incorporating the preferred embodiment of the invention, as seen from the side to which the rest of the photomultiplier tube is attached. Faceplate 10 is divided into four independent photocathodes 12, 14, 16 and 18, which are separated by slots 20 and 22 within faceplate 10.

Photocathodes 12, 14, 16 and 18 are each an individual curved surface to aid in focusing the electrons emitted from the individual photocathodes, so that the emitted electrons will be directed toward the individual electron multiplier sections (not shown) which are associated with each individual photocathode. The curve of each photocathode is such that its center of curvature is located within the assembled tube.

Slots 20 and 22 are located between the photocathodes and isolate each photocathode from those adjacent to it. Although slots 20 and 22 can be of varying depths within faceplate 10, they are each constructed so that the bottom of each slot is always located depressed below the edges of the photocathodes which it borders. For instance, as photocathodes 14 and 16 curve upward as they approach edge 24 of faceplate 10, slot 20 may also curve upward, but the bottom of slot 20 should always be deeper within faceplate 10 than the edges of photocathodes 14 and 16. Similarly, the bottom of slot 20 must dip lower as photocathodes 14 and 16 curve downward to the lowest points on their boundaries at locations 26 and 28. Essentially, the slots should be continuous in any region of faceplate 10 which contains photocathodes.

The construction of slots 20 and 22 can, however, be simplified if the central portion of the slots, for instance the portion of slot 20 between locations 26 and 28, is constructed with its bottom in a single plane. Thus, in that region, although the edges of the photocathodes curve upward, the bottom of slot 20 remains in the same plane causing the sides of slot 20 to increase in height as it approaches center 30 of faceplate 10. It is also advantageous to metallize the sides of slots 20 and 22 to reduce the transmission of light between the individual photocathodes.

Figure 2:
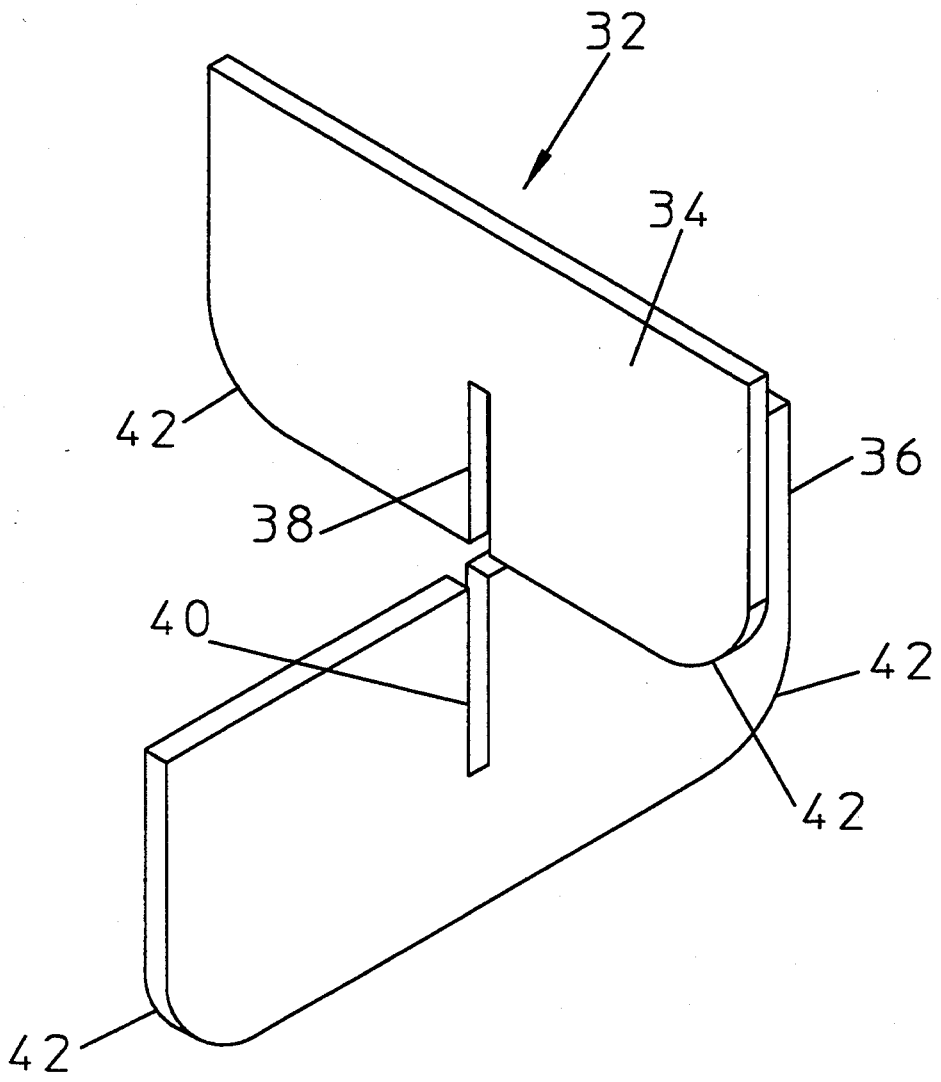
FIG. 2 is a perspective view of a separator electrode for use with the slotted faceplate structure of FIG. 1.

Slots 20 and 22 are constructed in the manner described so that they my receive a separator electrode such as that pictured in FIG. 2, in which separator electrode 32 is shown as it would be partially assembled from separator sections 34 and 36. The assembly of separator electrode 32 uses the simple structure of the classic egg crate in which matching slots 38 and 40 are formed in separator sections 34 and 36. Slots 38 and 40 are then slipped into each other to interlock separator sections 34 and 36.

Separator sections 34 and 36 are constructed of sheet metal of a thickness so that separator electrode 32 will slip into slots 20 and 22 of faceplate 10 of FIG. 1, and so that one edge of each of separator sections 34 and 36 will match the configuration of the bottom of the slot into which the separator section fits. Rounded corners 42 of the separator sections are formed to match the curvature of slots 20 and 22 (FIG. 1) as the slots curve to follow the curve of the photocathodes near the edges of faceplate 10. It should be noted, however, that when the tube is fully assembled, separator electrode 32 does not touch the bottom of slots 20 and 22. This clearance allows for the differential thermal expansion of the separator electrode and the tube envelope, and prevents thermal stress from developing in the structure.

Since the bottoms of slots 20 and 22 are constructed to always be below the edges of the adjacent photocathodes, once separator electrode 32 is inserted into slots 20 and 22, no edge of separator electrode 32 is exposed adjacent to faceplate 10, and each of the photocathodes is fully isolated from the other photocathodes. Furthermore, since the thickness of separator electrode 32 and the width of slots 20 and 22 can easily be selected for a clearance fit, slots 20 and 22 act as a lateral support for separator electrode 32 to assure permanent and perfect alignment between the photocathodes and their respective electron multipliers sections. However, with sliding clearance between separator electrode 32 and the sides of slots 20 and 22 within which it is located, separator electrode 32 can be attached to the electron multiplier sections (not shown) of the photomultiplier tube and the clearance within the slot accommodates to differential thermal expansion of the separator electrodes and the tube envelope. Without such accommodation to differential thermal expansion, damage to the tube structure would likely result during either initial processing or operation of the tube.

Figure 3:
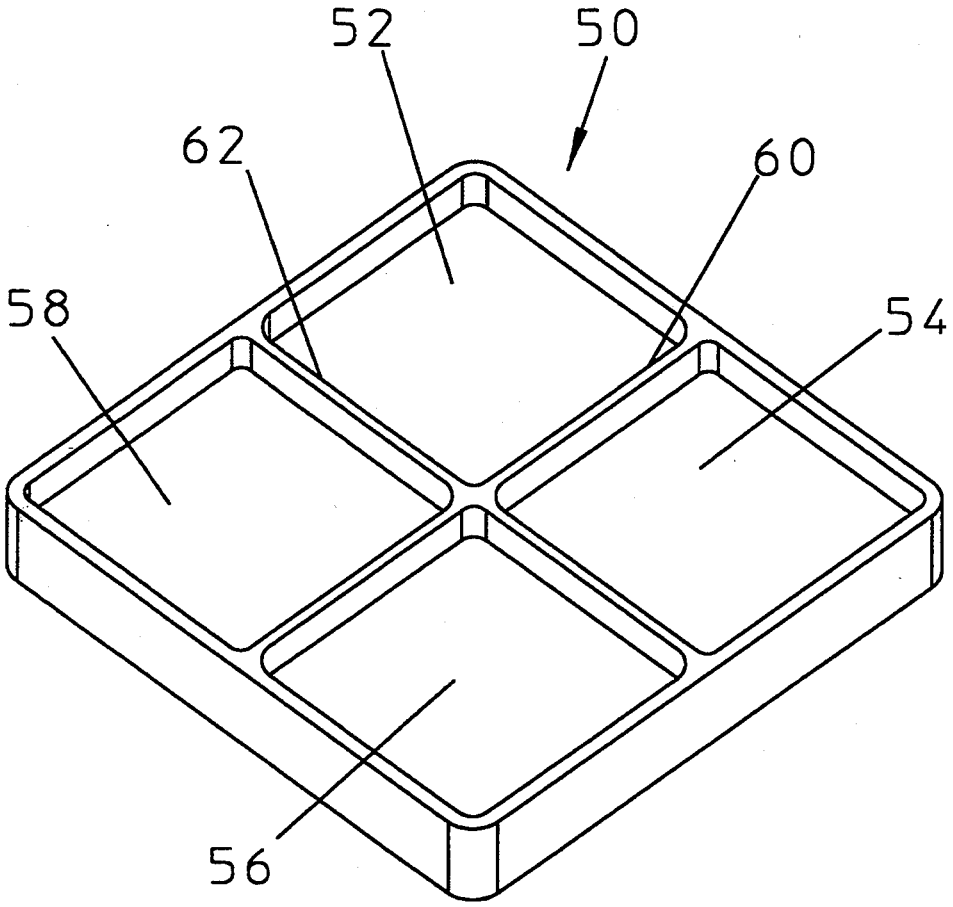
FIG. 3 is a perspective view of the face plate of an alternate embodiment shown with planar photocathode sections and raised ribs for engagement with the separator electrodes.

FIG. 3 depicts an alternate embodiment of the invention in which faceplate 50 includes photocathodes 52, 54, 56 and 58 which are formed as independent planar structures, and the focusing of the electrons emitted from each photocathode is accomplished only by the separator electrodes and other focusing electrodes (not shown). FIG. 3 also shows an alternate support structure for the dividers on face plate 50. Rather than the slots of FIG. 1, the faceplate dividers of FIG. 3 are ribs 60 and 62 which extend across faceplate 50 and intersect at the center of faceplate 50. Ribs 60 and 62 are constructed with their exposed edges all in one plane, because that is the most convenient structure for engagement of the separator electrode, but under some circumstances other configurations of the ribs may be desirable. The sides of ribs 60 and 62 are metallized to aid in reducing optical crosstalk between the individual photocathodes.

Figure 4:
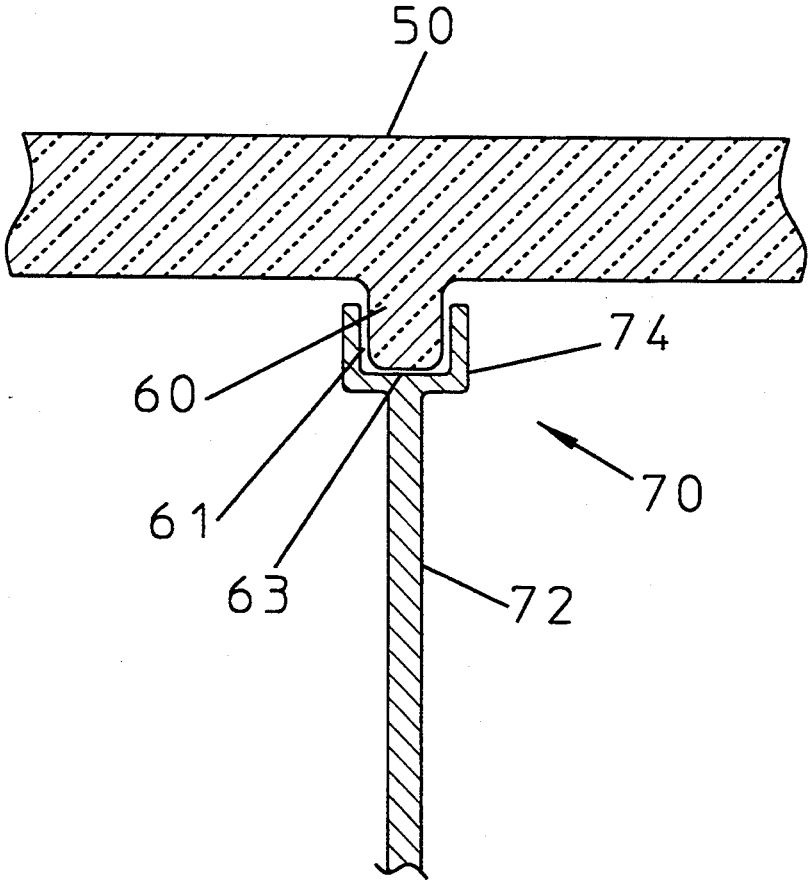
FIG. 4 is a cross section view of a portion of a separator electrode which can be engaged with the raised ribs on the faceplate of FIG. 3.

FIG. 4 is a cross section view of a part of a separator electrode 70 showing one means of connection of separator section 72 to divider rib 60. To accomplish the connection, clamp fixture 74 is attached to separator section 72 by conventional methods, such as spot welding, and separator electrode 70 is simply slipped over rib 60 which extends from faceplate 50. This system engages separator electrode 70 with faceplate 50 and, Just as the slotted faceplate divider, it maintains both the isolation between photocathodes and the alignment between the photocathodes and their respective electron multipliers. As with the slots, sufficient clearance must be permitted between clamp fixture 74 and sides 61 of rib 60, and between clamp fixture 74 and top 63 of rib 60 to allow for any anticipated differential thermal expansion.

Figure 5:
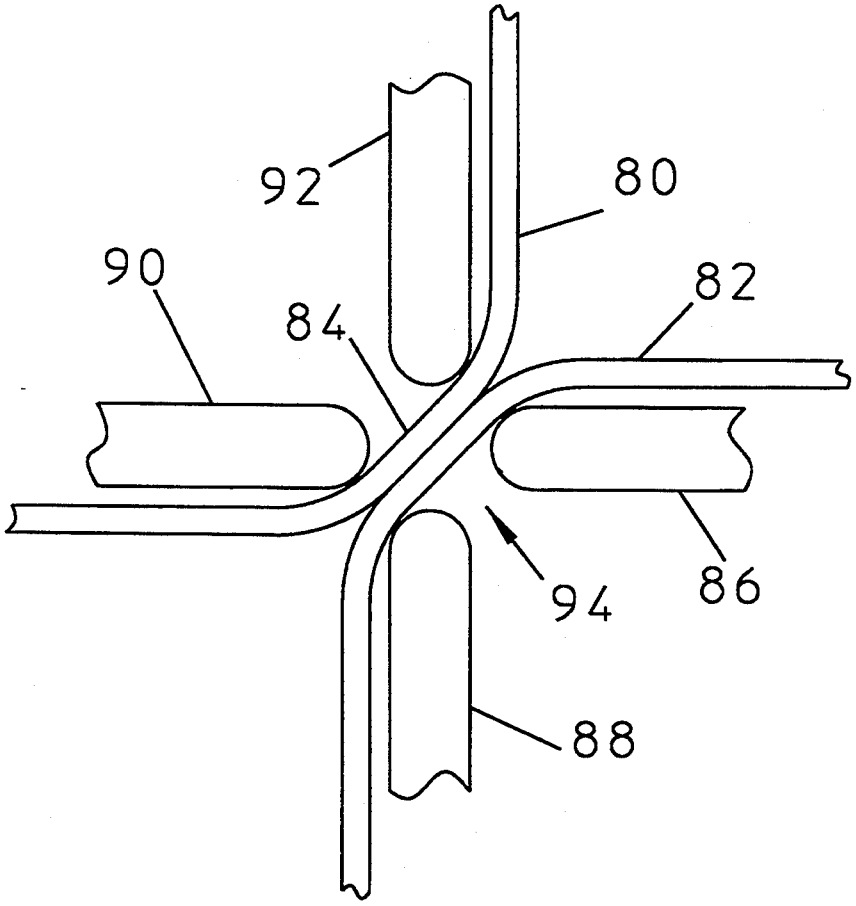
FIG. 5 is a plan view of part of a faceplate showing an alternate structure for engaging the separator electrode with the faceplate.

FIG. 5 is a view which depicts an alternate structure for engaging the separator electrode with ribs on the faceplate. In such an arrangement, separator electrode sections 80 and 82 are attached to each other in central region 84 by conventional methods such as spot welding, and are captured by ribs 86, 88 90 and 92. Ribs 86, 88, 90 and 92, only a portion of which are shown, are similar to the ribs shown in FIG. 3 except that they do not actually intersect. Central region 94 is instead used to accommodate the change in angular direction of each of the sections 80 and 82 of the separator electrode. As can be seen in FIG. 5, the location of sections 80 and 82, with each section straddling a pair of ribs, prevents sections 80 and 82 from moving relative to the ribs, thus locking the entire separator electrode in place on the faceplate.

The embodiments of the invention therefore produce superior multiple section photomultiplier tubes with more accurate alignment of the individual sections and virtually perfect isolation from crosstalk in the region between the photocathode and the first dynode.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, planar photocathodes could be used with slotted faceplate dividers, or curved photocathodes could be used with ribbed dividers. Moreover, the faceplate, and also the entire tube, could be divided into a greater or lesser number of sections.

What is claimed as new and for which Letters Patent of the United States are desired to be secured is:

1. An internal structure for a multiple section photomultiplier tube comprising:

a faceplate with its surface internal to the tube including at least two photocathodes;

at least two dynodes operating as part of at least two electron multipliers located within the tube;

separator electrodes located adjacent to the photocathodes and in the region between the photocathodes and the dynodes, and dividing the region adjacent to the photocathodes into the same number of individual spatial sections as there are photocathodes; and divider means attached to the faceplate, the divider means separating the faceplate into individual isolated photocathodes and serving as a means for engaging the separator electrodes with the faceplate.

2. The internal structure for a multiple section photomultiplier tube of claim 1 wherein the divider means is at least one slot in the faceplate, each slot having a bottom which is depressed below the edge of the photocathodes to which the slot is adjacent, and wherein the separator electrodes are planar sheets with edges which are fitted into the slots.

3. An internal structure for a multiple section photomultiplier tube comprising:

a faceplate with its surface internal to the tube including at least two photocathodes;

at least two dynodes operating as part of at least two electron multipliers located within the tube;

separator electrodes located adjacent to the photocathodes and in the region between the photocathodes and the dynodes, and dividing the region adjacent to the photocathodes into the same number of individual spatial sections as there are photocathodes;

divider means attached to the faceplate, the divider means separating the faceplate into individual isolated photocathodes and serving as a means for engaging the separator electrodes with the faceplate; and wherein the divider means is at least one rib, with at least a portion of the rib extending from the faceplate to a height above the edges of the photocathodes to which the rib is adjacent, and wherein the separator electrodes include a clamp means attaching the separator electrodes to the ribs.

4. The internal structure for a multiple section photomultiplier tube of claim 1 wherein each individual photocathode is curved and the centers of curvature of the photocathodes are within the photomultiplier tube.

5. The internal structure for a multiple section photomultiplier tube of claim 1 wherein each individual photocathode is planar.

6. An internal structure for a multiple section photomultiplier tube comprising:

a faceplate with its surface internal to the tube including at least two photocathodes;

at least two dynodes operating as part of at least two electron multipliers located within the tube;

separator electrodes located adjacent to the photocathodes and in the region between the photocathodes and the dynodes, and dividing the region adjacent to the photocathodes into the same number of individual spatial sections as there are photocathodes;

divider means attached to the faceplate, the divider means separating the faceplate into individual isolated photocathodes and serving as a means for engaging the separator electrodes with the faceplate; and wherein the divider means is at least four ribs, with at least a portion of each rib extending from the faceplate to a height above the edges of the photocathodes to which the rib is adjacent, and wherein the separator electrodes are curved to fit through spaces between the ribs and be located adjacent to the ribs.

7. The internal structure for a multiple section photomultiplier tube of claim 1 wherein the divider means is constructed with metallized surfaces.

* * * * *